US007552555B2

(12) United States Patent
Pellecuer et al.

(10) Patent No.: US 7,552,555 B2
(45) **Date of Patent: *Jun. 30, 2009**

(54) PUBLICITY MEDIUM

(76) Inventors: Jean-Luc Pellecuer, Mas de la Vierge, F-34130 Mauguio (FR); Raphael Salles, 12 Goule de Laval, F-34790 Grabels (FR)

( * ) Notice: Subject to any disclaimer, the term of this patent is extended or adjusted under 35 U.S.C. 154(b) by 2 days.

This patent is subject to a terminal disclaimer.

(21) Appl. No.: 10/513,635

(22) PCT Filed: May 6, 2003

(86) PCT No.: PCT/FR03/01396

§ 371 (c)(1),
(2), (4) Date: May 13, 2005

(87) PCT Pub. No.: WO03/096313

PCT Pub. Date: Nov. 20, 2003

(65) Prior Publication Data

US 2005/0252055 A1 Nov. 17, 2005

(30) Foreign Application Priority Data

May 10, 2002 (FR) ..... 02 05788

(51) Int. Cl.
*E01F 9/00* (2006.01)

(52) U.S. Cl. ..... 40/610; 40/745; 446/221; 52/2.18

(58) Field of Classification Search ..... 40/745, 40/610, 607.04; 482/35; 446/221; 52/2.18
See application file for complete search history.

(56) References Cited

U.S. PATENT DOCUMENTS

| | | | | |
|---|---|---|---|---|
| 4,807,405 | A | 2/1989 | Borgquist | |
| 5,402,591 | A | 4/1995 | Lee | |
| 5,987,822 | A * | 11/1999 | McNiff et al. | 52/2.11 |
| 6,192,633 | B1 * | 2/2001 | Hilbert | 52/2.18 |
| 6,263,617 | B1 | 7/2001 | Turcot | |

FOREIGN PATENT DOCUMENTS

| | | | |
|---|---|---|---|
| FR | 940 236 | A | 12/1948 |
| FR | 992 086 | A | 10/1951 |
| GB | 2 335 299 | A | 9/1999 |
| GB | 2 340 852 | A | 3/2000 |

* cited by examiner

*Primary Examiner*—Paul N Dickson
*Assistant Examiner*—Shin Kim
(74) *Attorney, Agent, or Firm*—Egbert Law Offices PLLC

(57) ABSTRACT

The invention relates to a publicity medium which is intended to be used during outdoor or indoor commercial, sporting or other types of events. The device includes flexible panels, the panels being stretched over and/or fixed to a support structure. The support structure has an assembly of tubes which are inflated at a relative pressure of between 0.15 and 0.8 bars.

7 Claims, 1 Drawing Sheet

FIG. 1
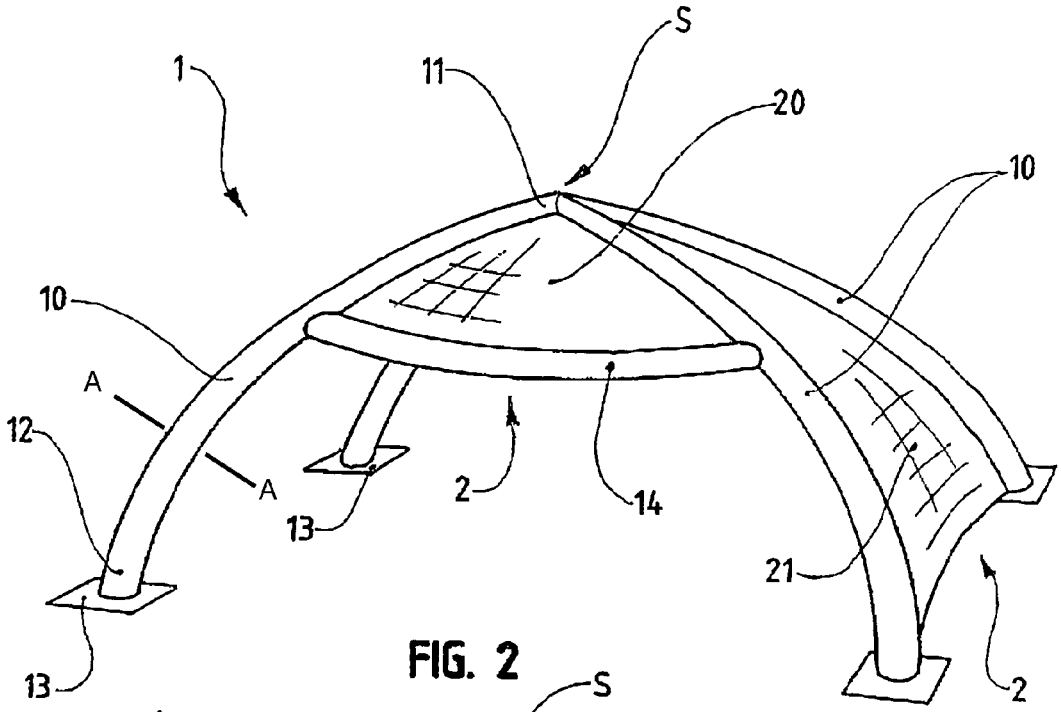
FIG. 2
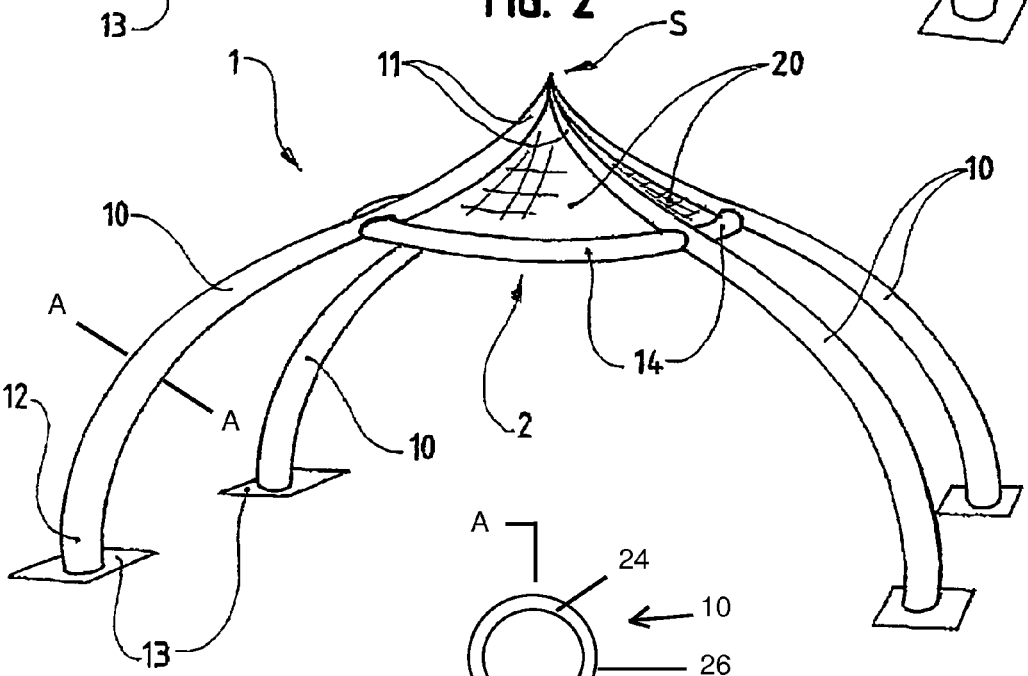
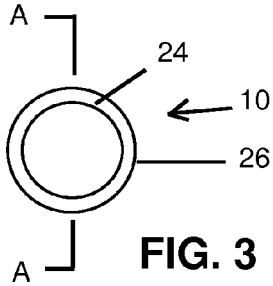
FIG. 3

PUBLICITY MEDIUM

RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention refers to a communication carrying device, in particular for use during commercial, sports or other indoor or outdoor events.

Such a communication carrying device is in particular aimed at being a meeting place, visible from a considerable distance because of its original esthetics and its particular dimensions.

BACKGROUND OF THE INVENTION

Currently known communication carrying devices consist of rigid panels, or of flexible panels stretched and/or fixed on a rigid structure such as a metal frame, said panels carrying the information to be spread.

Such devices have disadvantages, in particular regarding their transport and sometimes their implementation.

BRIEF SUMMARY OF THE INVENTION

This invention is aimed at providing a communication carrying device permitting to cope with these various disadvantages.

The communication carrying device, in particular for use during commercial, sports or other indoor or outdoor events according to the invention, is of the type comprising flexible panels containing the information to be spread, said panels being stretched and/or fixed on a bearing structure, and it is essentially characterized in that said bearing structure consists, of an association of tubes inflated at a relative pressure between 0.15 and 0.8 bars.

According to an additional feature of the device according to the invention, the structure includes at least three inflatable tubes of a slightly truncated conical shape, at the end with the largest cross-section of which is made integral a base, bases being laid on the ground and spaced from each other by a certain distance, whereas the other ends, of a narrower cross-section, are put together to form the top of the structure.

According to another additional feature of the device according to the invention, the bases consist of plates.

According to another additional feature of the device according to the invention, the bearing structure includes, near its top, tubes arranged transversally between two adjacent tubes.

According to another additional feature of the device according to the invention, the bearing structure includes transversal tubes extending between two non adjacent tubes.

According to another additional feature of the device according to the invention, the flexible panels on which appear the information to be spread are in the form of canvases extending between some of the tubes of the structure.

According to another additional feature of the device according to the invention, each tube includes an elastic impermeable internal envelope, and an external envelope made of an inelastic resistant tissue. The internal envelope is inflated in the external envelope, since the external envelope is inelastic and not inflatable further.

Preferably, the external envelope is made of Mylar®, Dacron® or the like.

According to another additional feature of the device according to the invention, the integral connection of the tubes to each other and of the panels to the tubes is made by means of sewing operations.

Sewing has the advantage of improving the stability of the structure by making integral the tubes at a point.

It should be noted that advantageously the panels, or just some of them, can be made integral with the tubes by means for reversible fastening.

Also, it should be noted that it is absolutely possible to use the surface of the tubes for spreading information.

A device according to the invention made in this way has an exceptional weight/rigidity ratio, which permits to solve problems experiences with the current devices, viz. problems of weight, space, transport, installation, safety . . .

Furthermore, the device according to the invention has advantageously an interesting esthetic.

The advantages and the features of the device according to the invention will become clear from the following description, when referring to the attached drawing, which represents a non-restrictive embodiment thereof.

BRIEF DESCRIPTION OF THE SEVERAL VIEWS OF THE DRAWINGS

FIG. 1 represents a perspective view of a communication carrying device according to the invention.

FIG. 2 represents another perspective view of a variant of the same device.

FIG. 2 shows a cross-section view of a tube as used in the communication carrying device of the present invention.

FIG. 3 shows a cross-section of the tube 10. Tube 10 is illustrated as having an elastic impermeable envelope 24 and an external envelope 26 formed of an inelastic tear-resistant material. The external envelope 26 can be formed of Mylar (TM), Dacron (TM), or the like.

DETAILED DESCRIPTION OF THE INVENTION

Referring to FIG. 1, it can be seen that a communication carrying device, in particular for use during commercial, sports, and other indoor or outdoor events, according to the invention includes a bearing structure 1 comprising four tubes 10 inflatable at high pressure, made integral with each other by an end 11 in order to form the top S of the device, whereas their other end 12 includes a base 13.

The bases 13 consist of plates made integral with the ends 12 of the tubes, which are spaced from each other at a certain distance and are likely to be covered with heavy elements, snow, sand, etc. . . . , in order to ensure the anchoring of the structure 1 to the ground.

It should be noted that the tubes 10 have preferably a truncated conical shape, i.e. the ends 12 have a cross-section larger than that of the ends 11. This feature enhances the stability of the bearing structure 1.

The bearing structure 1 also includes a transversal tube 14, extending between two adjacent tubes 10 near the top S.

It should be noted that such a tube 14 can extend between each pair of adjacent tubes 10.

It should also be noted, in a variant that is not shown, that the bearing structure 1 can include transversal tubes extending between two non adjacent tubes 10, in this case between two tubes 10 opposite each other, since the bearing structure 1 shown includes four tubes 10. This disposition also aims to enhance the stability of the whole.

The device according to the invention also includes panels 2 bearing information aimed at being spread, which consist of pieces of canvas, and which, in the embodiment shown, adopt two different forms, viz. a canvas 20 extending between the top S, a tube 14 and two adjacent tubes 10, and a canvas 21 extending between two adjacent tubes 10, from the top S to the ends 12.

When referring now to FIG. 2, a variant of the communication carrying device according to the invention can be seen.

It also includes a structure 1 formed by assembling tubes 10 and transversal tubes, associated with panels 2 consisting of canvases 20 extending between the top S, a tube 14 and two adjacent tubes 10.

This device according to the invention differs from the preceding ones essentially in that the ends 11 of the tubes 10 are put together side-by-side, and not end-to-end, in order to provide the structure with a pointed and non ogival shape.

In both embodiments, the integral connection of the panels 2 to the bearing structure 10 is made by sewing and/or through means permitting a reversible fastening.

FIG. 3 shows a cross-section of the tube 10. Tube 10 is illustrated as having an elastic impermeable envelope 24 and an external envelope 26 formed of an inelastic tear-resistant material. The external envelope 26 can be formed of Mylar™, Dacron™, or the like.

It is obvious that this invention cannot be limited to the preceding description of several of its embodiments, and that it can undergo some changes without departing from the scope of the invention.

We claim:

1. A communication carrying apparatus comprising:

a bearing structure having four tubes extending upwardly from a bottom to a top, each of said four tubes having a slightly truncated conical shape, two of said four tubes extending in a first plane and another two of said four tubes extending in a second plane intersecting said first plane, said bottom having a cross-sectional area greater than a cross-sectional area at said top, the top of said four tubes being joined together at a top of said bearing structure and radiating outwardly therefrom, each of four tubes being inflated at a relative pressure of between 0.15 and 0.8 bars, each of said four tubes having an internal elastic impermeable envelope and an external envelope formed of an inelastic tear-resistant materials;

a base affixed to said bottom of each of said four tubes, said base suitable for resting on an underlying surface, the base of said four tubes being spaced from and connected with each other;

a first transversal tube affixed to and extending between a first pair of said four tubes in spaced relation to said top of said bearing structure and in spaced relation to said base;

a second transversal tube affixed to and extending between a second pair of said four tubes in spaced relation to said top of said bearing structure and in spaced relation to said base;

a first flexible panel affixed so as to be bounded only between said first pair of said four tubes and said first transversal tube, said first flexible panel having visible information thereon; and a second flexible panel affixed so as to be bounded only between said second pair of said four tubes and said second transversal tube, said second flexible panel having visible information thereon.

2. The apparatus of claim 1, said base being a plate.

3. The apparatus of claim 1, each of said first flexible panel and said second flexible panel being a canvas.

4. The apparatus of claim 1, said internal elastic impermeable envelope being formed of a latex material.

5. The apparatus of claim 1, said first flexible panel being sewed to said first pair of said four tubes and to said first transversal tube, said second flexible panel being sewed to said second pair of said four tubes and to said second transversal tube.

6. The apparatus of claim 1, further comprising:

a third flexible panel affixed to a third pair of said four panels, said third flexible panel having an area that is greater than an area of either of said first flexible panel and said second flexible panel.

7. The apparatus of claim 1, each of said four tubes being arch-shaped.

* * * * *